US005226532A

United States Patent [19]

Davidson et al.

[11] Patent Number: 5,226,532

[45] Date of Patent: Jul. 13, 1993

[54] GIFT CONTAINER AND GREETING CARD HOLDER

[75] Inventors: Leon N. Davidson, Reseda; Ray L. Solari, Beverly Hills, both of Calif.

[73] Assignee: Cards 'N' Pouches, Inc., Beverly Hills, Calif.

[21] Appl. No.: 895,630

[22] Filed: Jun. 9, 1992

[51] Int. Cl.[5] ..... B65D 85/00

[52] U.S. Cl. ..... 206/232; 229/242; 229/244; 229/120.21; 206/457; 40/124.1

[58] Field of Search ..... 229/242, 243, 244, 229, 229/120.21; 206/232, 457, 491, 476, 216; 40/124.1

[56] References Cited

U.S. PATENT DOCUMENTS 3,533,549 10/1970 Gilchrist ..... 229/242
4,096,948 6/1978 Kuchenbecker ..... 229/243 X
4,433,780 2/1984 Ellis ..... 206/232
4,828,105 5/1989 Silengo et al. ..... 206/232
5,038,930 8/1991 Holtcamp, Jr. ..... 206/232
5,096,058 3/1992 Juravin et al. ..... 206/232

*Primary Examiner*—Steven N. Meyers
*Assistant Examiner*—Jacob K. Ackun, Jr.
*Attorney, Agent, or Firm*—George J. Netter

[57] ABSTRACT

A gift container and greeting card holder is formed from a cutout blank (10) with three panels (12,14,16). The first and third panels (12,16) have removable central portions (31,76) defined by lines of perforations including strips (34,80,82) which are pulled loose by the aid of pull tabs (33,84,86). Assembly is achieved by folding the first and third panels onto the central second panel (14) after the gift is entered into a containing space via open edge walls after which the panels and edge strips are sealed together.

3 Claims, 2 Drawing Sheets

GIFT CONTAINER AND GREETING CARD HOLDER

BACKGROUND

The present invention relates to the combination of a greeting card holder and gift container, and, more particularly, to such a combination especially constructed for carrying relatively small gift items.

SUMMARY OF THE INVENTION

A gift container and greeting card construction of the present invention is formed from a rectangular sheet-like cardboard or heavy paper base having three interconnected panels. A first panel, adjacent one end has a central portion enclosed on three sides by perforations and scored areas enabling the central portion to be released and folded away from an edge border leaving exposed a central viewing area for a purpose to be described. The first panel edge portions include adhesive areas covered over by protective tape, the latter, in use, being peeled off to enable adhering the first panel to one of the other panels in a way that will be described.

At the opposite end of the base, a third panel includes a central portion which also is perforated along three sides with a pair of pull members which serve to break or release the perforations. In assembly, the third panel is folded back over the second or central panel and the first panel adhered to the third panel. The removable central portion of the third panel is of a size enabling direct viewing when the central portion of the first panel is removed and folded over the third panel.

It is contemplated that the combination gift container and greeting card be sold for use by the average individual purchaser of small gifts. Specifically, it is sold with the third panel folded back over the second panel and adhered to a formed portion of the second panel, and over which the first panel folds to cover the third panel. Various crease lines are provided so that the entire assembly can be formed readily into a flat package for shipping or storage prior to sale.

When it is desired to use the item, the opposite edges are pushed towards each other forming a generally box arrangement between the second and third panels providing a space within which the gift, such as a CD or the like, can be placed and the container space opposite open ends are closed and sealed by removal of a strip of protective tape from adhesive areas on each of these ends. The card can then be inserted into the central portion of the third panel and card receiving notches or slits aid in securing the card in position. Finally, the first panel then has protective tape covering adhesive areas removed and can be pressed directly onto the third panel completely enclosing and finishing off the gift container.

Optionally, either the front of the first panel or the back of the center panel or second panel may by used for receiver address and return address information. On receipt of the invention, the perforations defining the central portion on the first panel are severed by pulling on two tabs which exposes the underlying card. The card may be then lifted out and the central portion of the third panel removed exposing the gift within the container.

DESCRIPTION OF A PREFERRED EMBODIMENT

Figure 1:
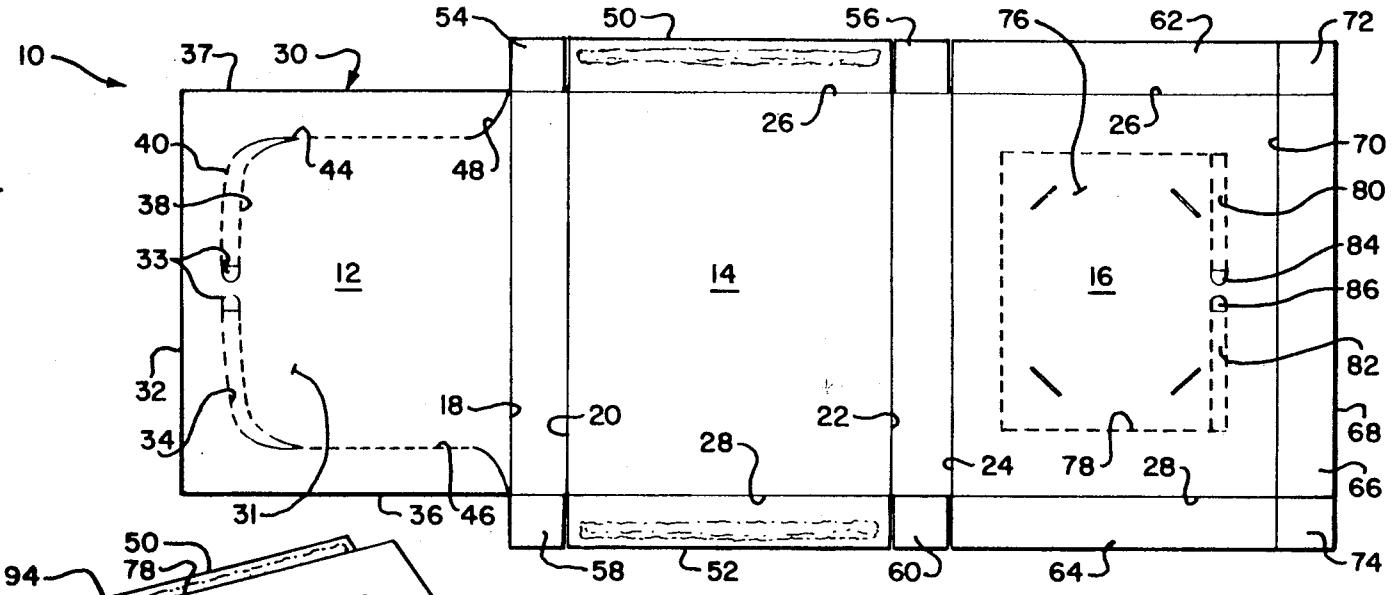
FIG. 1 is a top plan view of the invention shown disassembled and opened up.
Figure 2:
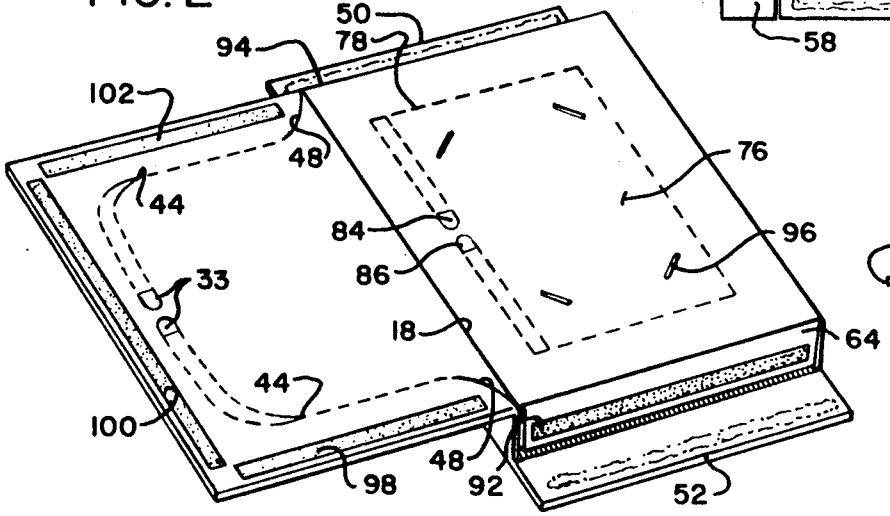
FIG. 2 is a perspective view of the invention shown partially assembled.
Figure 4:
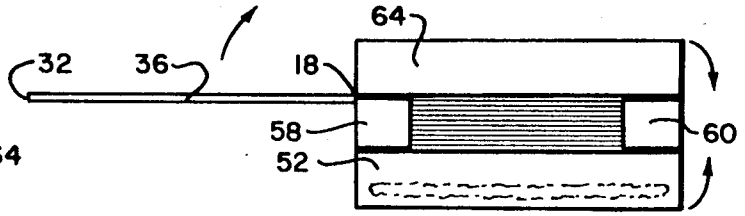
FIG. 4 is a side elevational view showing the sides opened up.
Figure 3:
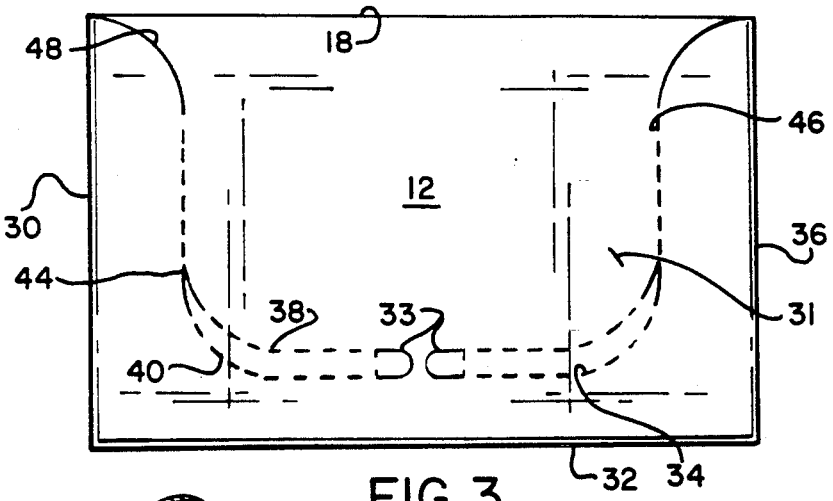
FIG. 3 is a front view of the assembled invention.
Figure 5:
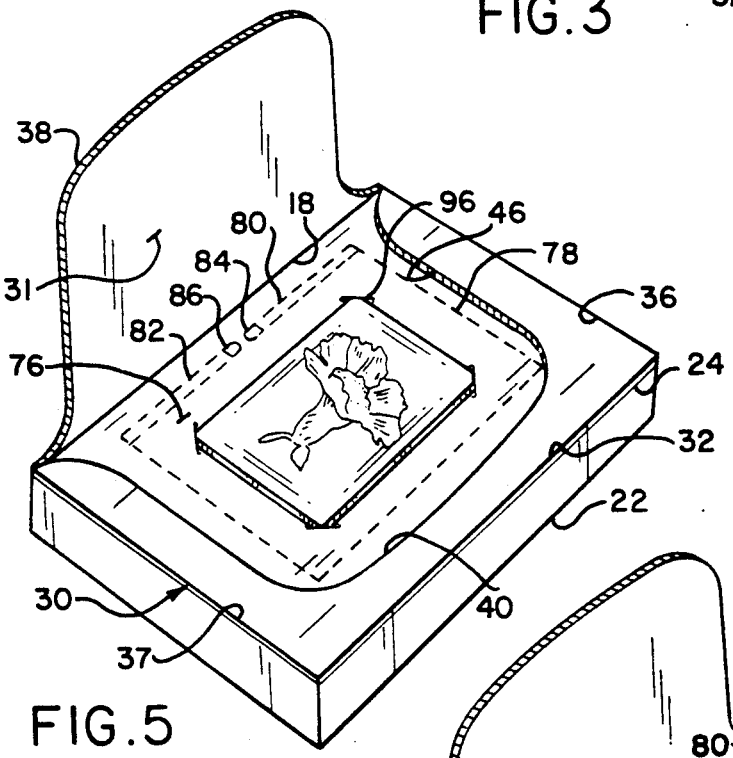
FIG. 5 shows the greeting card and gift container of FIG. 3 showing an outer flap released and folded back.
Figure 6:
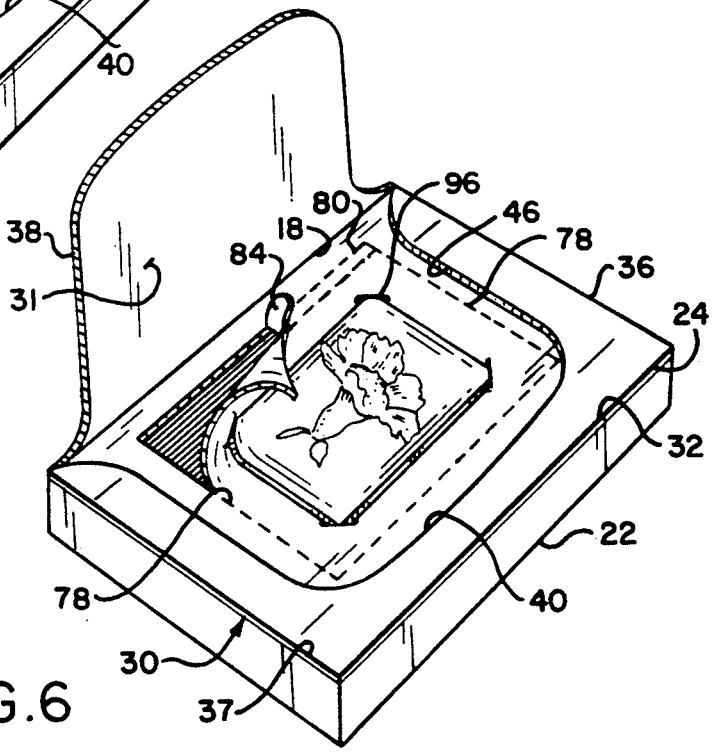
FIG. 6 is similar to FIG. 5 showing an internal flap partially released to expose the container interior.

With reference to the drawing and particularly FIG. 1, there is shown a cutout blank 10 from which the combination gift container and greeting card holder of the present invention is assembled. Specifically, the cutout blank 10 is rectangular with three substantially equal area panels 12, 14 and 16 arranged adjacent each other along the cutout blank long dimension and which are separated by transversely extending and mutually parallel fold lines 18, 20, 22 and 24. In addition, adjacent each of the long side edges of panels 14 and 16 there are provided further fold lines 26 and 28 which are located at equal distances from the adjacent edges and, as will be more particularly described, form the thickness for the container portion of the invention as well as defining edge walls for enclosing the container space.

The panel 12 is located at one end of the blank and includes a line of severance 30 extending along three sides of a central portion 31 that is generally rectangular. More particularly, the severance line 30 is split into two symmetrical generally identical portions as measured from substantially the center of the end edge 32. Specifically, each half of the severance line includes beginning at the center of the edge 32 with a pull tab 33 which is interconnected with a strip 34 that extends over toward the lateral edge 36 or 37, as the case may be. The lateral sides of the strip are defined by lines 38 and 40 of perforations and upon reaching the strip outer terminus adjacent the panel edge 36 or 37 the strip sides taper down to a point 44. Immediately adjacent the point 44 both sides of the strip are cut from the remainder of the panel rather than being perforated and this cut end portion turns substantially 90° to the main strip body. The strip end point 44 interconnects with a line 46 of perforations which is parallel to the edge 36 (or 37) and extends upwardly toward the fold line 18 until at a point adjacent the fold line there is a scored curved portion 48 which terminates at the junction of the edge 36, 37 and fold line 18.

When it is desired to release the central portion 31 the two pull tabs 33 are pulled away from the sides which releases the strip 34 from the panel. After both of the strips are removed, then the remaining part of the central portion can be easily pulled toward the fold line 18 until the perforations along the side edges are released enabling the central portion to be folded along fold line 18.

The central panel 14 is generally rectangular with fold lines 26 and 28 being straight-line extensions of the first panel edges 37 and 36, respectively. Rectangular side wall strips 50 and 52 lying outwardly of fold lines 26 and 28 have width dimensions identical to the spacing between fold lines 18 and 20 as well as between fold lines 22 and 24. The extensions of fold lines 18, 20, 22 and 24 across strips 50 and 52 are cut through forming four tabs 54, 56, 58 and 60 which are readily foldable about respective fold lines 26 and 28.

The third panel 16 is also rectangular and has first and second side wall strips 62 and 64 lying outwardly of fold lines 26 and 28, each of a width identical to that of side wall strips 50 and 52. An end wall 66 having a width identical to side wall strips 62 and 64 is formed along the outer end edge 68 of the third panel by folding along fold line 70 and removing the two corner tabs 72 and 74.

The central portion 76 of the third panel 16 is generally rectangular and defined by a continuous set of perforations 78 extending parallel to and spaced from fold line 28, parallel to and spaced from fold line 24, parallel to and spaced from fold line 26 and parallel and spaced from fold line 70. Specifically, first and second equilength pull strips 80 and 82 with perforations along each side defines the side parallel and adjacent to the fold line 70. Pull tabs 84 and 86 on the respective ends of the strips 80 and 82 are next to one another and located closely adjacent the center of fold line 70.

In manufacturing assembly, the third panel 16 is folded back over the second panel 14 with the end wall 66, and secured to the panel material lying between fold lines 18 and 20 (e.g., adhesive). For storage and shipment prior to actual use, the first panel 12 may be folded over the second and third panels and the entire package be flattened by folding about fold lines 18 and 22 or 20 and 24.

When the invention is to be used, the gift to be transmitted is placed within the container through the open side walls. Next, the protective ribbons are removed from adhesive areas 92 and 94 on side walls 62 and 64, and these side walls (along with tabs 54, 56, 58, 60 tucked inside) are adhered to the respective sidewalls 50 and 52. A greeting card is located in receiving slots 96. Finally, protective ribbons are removed from adhesive areas 98, 100 and 102 arranged along the end and two adjacent edge portions of the first panel, following which the first panel is adhered onto the third panel. Address information can be applied to the major outer surfaces of either panel 12 or 16.

The receiver of the invention first of all pulls on the pull tabs 33 until the strips 34 separate from the panel at points 44. Then the remainder of panel central portion 31 is separated to fold line 18 by pulling on the central portion with the fingers extending through the space left by the removed strips 34. The underlying card may now be easily seen and read after which the central portion 76 of the third panel may be pulled loose to gain access to the enclosed gift.

Although the invention has been described in connection with a preferred embodiment, it is to be understood that those skilled in the appertaining arts may effect changes that come within the spirit of the invention as described and within the ambit of the appended claims.

What is claimed is:

1. A greeting card holder and gift container, comprising:

a sheetlike member of a relatively rigid material having a first panel adjacent one member edge, a second panel interconnected with the first panel by first means for enabling ready folding of the first and second panels with respect to each other, and a third panel adjacent another member edge and separated from the second panel by second means for enabling folding of the second and third panels with respect to each other;

the first panel having first and second strips formed by perforations at each side of said strips extending generally parallel to the one member edge and with end portions extending generally normally away from the one member edge and each terminating at a different point, said strips each having a pull tab centrally located along the one member edge;

said first panel having first and second lateral edges and first and second perforation lines extending from the respective strip termination points;

the third panel having an end edge, two lateral edges, two separate strips defined by perforations along strip edges and separate pull tabs for each strip, and a single perforation intersecting the perforations defining the strips and enclosing a central portion.

2. A greeting card holder and gift container as in claim 1, in which there are provided strips along the second and third panel lateral edges and third panel end edge; assembly including securing the third panel edge strip to the member adjacent the first means and adjacent second and third panel lateral edge strips are secured to one another.

3. A greeting card holder and gift container as in claim 1, in which the first panel first and second perforation lines each terminate in an outwardly curving position cut completely through the member material.

* * * * *